US008807401B2

(12) United States Patent
Taylor

(10) Patent No.: US 8,807,401 B2
(45) Date of Patent: Aug. 19, 2014

(54) SEALING ARRANGEMENT

(75) Inventor: Michael Taylor, Stockholm (SE)

(73) Assignee: Lindén International AB, Värnamo (SE)

( * ) Notice: Subject to any disclaimer, the term of this patent is extended or adjusted under 35 U.S.C. 154(b) by 33 days.

(21) Appl. No.: 13/877,516

(22) PCT Filed: Oct. 4, 2011

(86) PCT No.: PCT/SE2011/000173

§ 371 (c)(1),
(2), (4) Date: Apr. 3, 2013

(87) PCT Pub. No.: WO2012/047143

PCT Pub. Date: Apr. 12, 2012

(65) Prior Publication Data

US 2013/0305492 A1 Nov. 21, 2013

(30) Foreign Application Priority Data

Oct. 5, 2010 (SE) ..... 1000984

(51) Int. Cl.
*B65D 5/72* (2006.01)
*B65D 77/12* (2006.01)
*B65D 33/16* (2006.01)

(52) U.S. Cl.
CPC ..... *B65D 33/1633* (2013.01); *B65D 77/12* (2013.01); *B65D 33/1675* (2013.01)
USPC ..... 222/567; 222/106; 24/30.5 R

(58) Field of Classification Search
CPC .... B65D 77/12; B65D 77/18; B65D 33/1633; B65D 33/1641; B65D 33/1675
USPC ..... 222/567, 571–573, 92, 103, 106, 107; 383/33, 34, 34.1, 80, 906, 66.1, 193; 24/30.5 R
See application file for complete search history.

(56) References Cited

U.S. PATENT DOCUMENTS

| | | | | |
|---|---|---|---|---|
| 5,226,564 | A * | 7/1993 | Steer et al. | 222/107 |
| 5,678,732 | A * | 10/1997 | Gianpaolo | 222/107 |
| 6,354,459 | B1 * | 3/2002 | Hagihara | 220/705 |
| 6,378,731 | B1 * | 4/2002 | Klabes | 222/92 |
| 8,205,764 | B2 * | 6/2012 | Chang | 220/259.2 |
| 2014/0101895 | A1 * | 4/2014 | White et al. | 24/30.5 R |

FOREIGN PATENT DOCUMENTS

EP 0675050 A1 10/1995

OTHER PUBLICATIONS

JP11115952 A (Toppan Printing Co Ltd), Apr. 27, 1999; (abstract) Original document: figures 1-11.

JP11124151 A (Toppan Printing Co Ltd), May 11, 1999; (abstract) Original document: figures 1,2.

JP11147546 A (Danippon Printing Co Ltd), Jun. 2, 1999; (abstract) Original document: figures 1,3,4.

JP2000109113 A (Yoshino Kogyosho Co Ltd), Apr. 18, 2000; (abstract) Original document: figures 1-18.

International Search Report (Jan. 3, 2012) for corresponding International application No. PCT/SE2011/000173.

* cited by examiner

*Primary Examiner* — Lien Ngo
(74) *Attorney, Agent, or Firm* — WRB-IP LLP

(57) ABSTRACT

A sealing arrangement is intended for a flexible package. The sealing arrangement includes a circumferential sealing device which may be disposed about an opening in the package. An openable access device is provided for insertion in the opening of the package. The sealing device is disposed about the access device for urging the package against the access device.

6 Claims, 4 Drawing Sheets

SEALING ARRANGEMENT

BACKGROUND AND SUMMARY

The present invention relates to a sealing arrangement for sealing at flexible package, comprising a circumferential sealing device which is connectable about an opening in the package.

Many products, not least foodstuffs, are sold in bats or similar, flexible packages. Some examples of such products are fine gram products such as flour, coffee, hundreds-and-thousands, dried spices and the like, but other products such as cornflakes, dog food, macaroni and the like, where the product consists of or comprises pieces of larger size, also occur in bag-like packages, Finally, there are also products where the pieces included have a considerable spatial extent, such as for example crisps, small cakelets and packed confectionary.

Often, the entire contents of the package are not consumed immediately once the package has been opened, and in many cases this may be perceived as a problem. There is a risk that the contents leak out of the opened package, in particular if the package is accidentally overturned, which may result in untidying of storage space, such as cabinets, boxes, larders and the like. Attempts are generally made to close the package provisionally by, for example, folding its open end with several creases. If the type of package so permits, its upper end may be tied in a knot, but it is occasionally difficult to untie the knot without damaging the package. In order to obtain a closure or seal which more effectively prevents the contents from leaking out of the opened package, various types of plastic clamps are already known in the art, for example the clamp which is marketed under the trademark twixit!®. This clamp is fixed on the opened, flexible package in order to seal it, and when the package needs to be opened again, the clamp is removed.

The clamp functions per se very well as a closure of flexible packages, such as plastic bags, foil bags, sacks and the like, and is available in a series of different sizes.

When the clamp has been removed, access to the contents of the package may still prove problematical. One problem is that, in order for it to be possible to close the package with a clamp of the size which is available, only a small hole has been made in the package, e.g. a corner of the package has been torn off. It may be difficult or impossible to access into the contents of the package with the aid of a spoon through the tight opening. If the intention is to pour the contents out of the package, it is not certain that the shape of the opening is particularly suitable for pouring. Thus, the risk of spillage is quite serious and it is difficult to realise an exact dosing of the contents of the package. Surplus which has been taken from the package cannot always be returned to the package, but is thrown away, which gives rise to unnecessary waste of the packed product.

A further situation were pouring and access are difficult is when the package is worn and/or wrinkled, which may often be the case after a number of closing operations using a clamp or if the package has been folded or knotted together several times. Also in this case, there is a serious risk of spillage and waste of the product.

There is thus a need in the art to make for a closing and sealing and subsequent opening and access a repeated number of times of one and the same package.

A sealing arrangement according to an aspect of the present invention includes an openable access device is provided for insertion in the opening of the package and the sealing device is disposed about the access device for pressing the package against the access device.

BRIEF DESCRIPTION OF THE ACCOMPANYING DRAWINGS

The present invention will now be described in greater detail hereinbelow with reference to the accompanying Drawings. In the accompanying Drawings.

DETAILED DESCRIPTION

Figure 1:
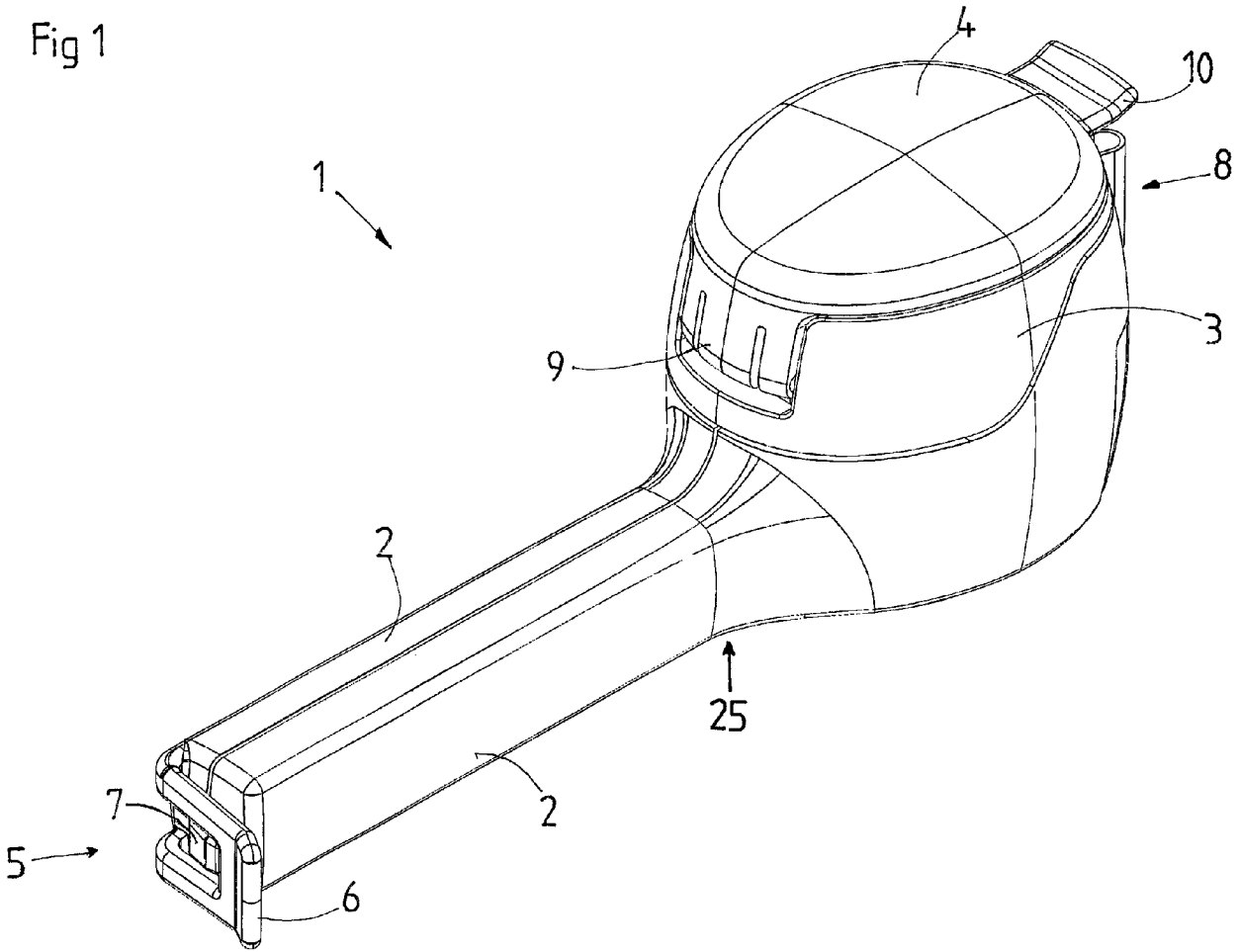
FIG. 1 is a perspective view of a dosed clamp according to the present invention.

In FIG. 1, a sealing arrangement is shown in the form of a clamp 1 according to the present invention. The clamp 1 includes two shanks 2 which serve to close and seal a package. The clamp 1 further displays an access device 3 by means of which it is possible to gain access to the contents of the package closed by the clamp 1, the lid 4 of the access device 3 being opened.

Each one of the shanks 2 has, at its one end, its part of a locking device 5 which realises a locking of the clamp in order for it to be able to close a package in an efficient manner. The locking device 5 is of a design which is per se previously known, with a collar 6 and a locking heel 7 which is snapped in place in the collar 6 on closing of the clamp 1. At the other end of the shanks 2 there is a partly obscured hinge device 8. In the region most proximal the hinge device 8, where the access device 3 is disposed, the shanks 2 are curved on the outside around the access device 3.

The access device 3, which is disposed between the shanks 2, is tubular so that access to the interior of the closed package is permitted through the tubular section, while the package is clamped between the outside of the access device 3 and the inside of the shanks 2 and between the shanks 2, respectively. The upper end of the access device 3, which is intended to face out from the closed package, is provided with a lid 4 for opening and closing of the access device 3. The lid 4 is pivotally disposed at the outer end of the access device 3. In the preferred embodiment, the pivot is a hinge 9. At the opposite end of the lid 4 there is a gripping flap 10 for opening the lid 4. Below the gripping flap 10, substantially in the inside of the access device 3 and on the underside of the lid 4, respectively, there are provided closing members 22, 23 for the lid 4.

The access device 3 and the rest of the clamp 1 are, in the preferred embodiment, manufactured by injection moulding, in two pans, possibly in two different plastic materials.

Figure 2:
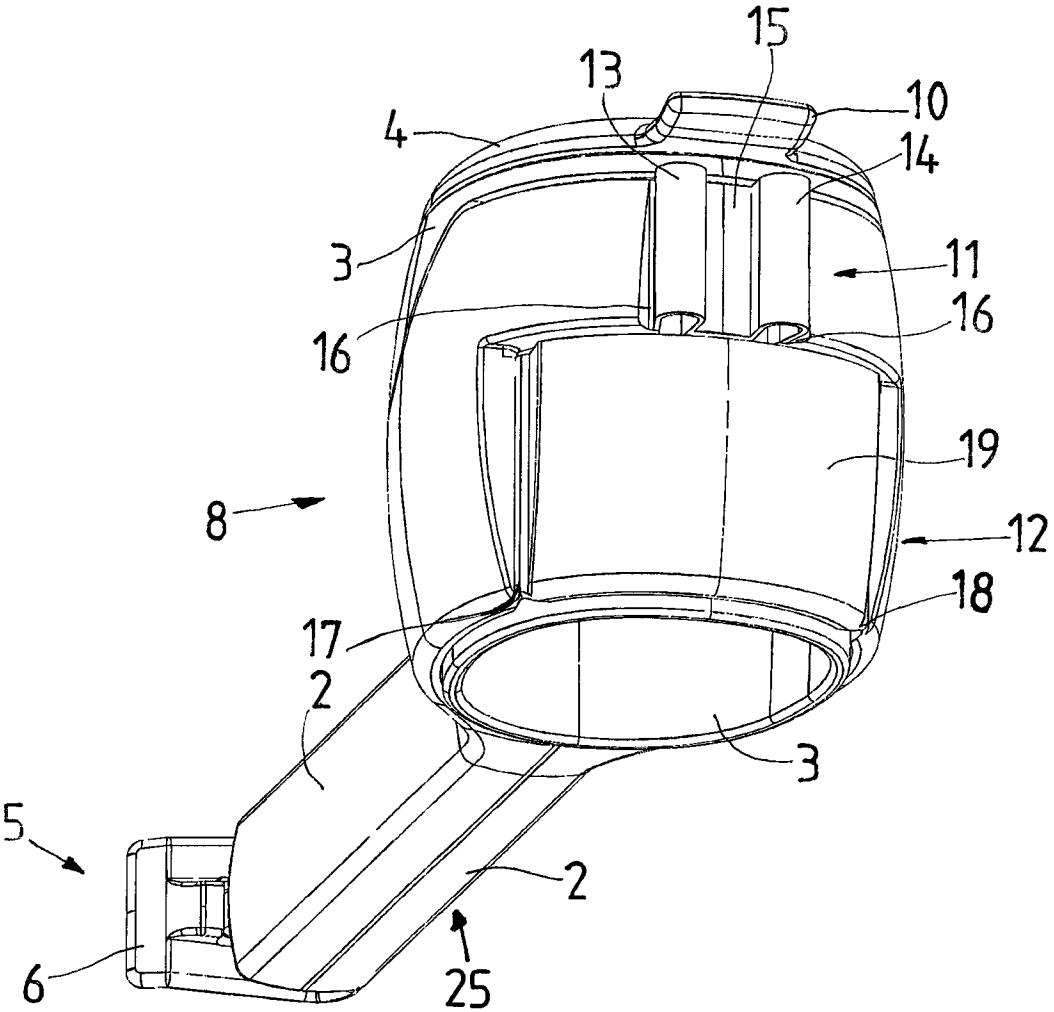
FIG. 2 is a perspective view obliquely from beneath of the clamp according to FIG. 1.

FIG. 2 shows the clamp obliquely from beneath with the end where the hinge device 8 is located facing towards the observer. As a result, the hinge device 8 is better visible than in FIG. 1. Initially, it may be ascertained that the hinge device 8 comprises two parts, an upper portion 11 and a lower portion 12. The upper portion 11 of the hinge device 8 comprises two hinge members 13, 14, which are disposed in spaced apart relationship from one another so that an intermediate portion 15 is formed between the hinge members 13, 14 in the illustrated embodiment, the hinge members 13, 14 are designed as two creases, with thinner portions 16 disposed at the transition between the creases and the shanks 2, for realising a flexibility, at the same time as the creases in the hinge members 13, 14 are also flexible.

The intermediate portion 15 is fixedly connected to the inwardly neighbouring access device 3, for example by gluing or ultrasound welding. The two shanks 2 will thus, on outward flexing, move away from the access device 3 apart from in precisely this portion.

The lower portion 12 also includes two hinge members 17, 18. The two hinge members 17, 18 are disposed at a mutually greater distance from one another than the two hinge members 13, 14 in the upper portion 11 of the hinge device 8. The intermediate portion 19 is, because of its extent in the circumferential direction of the access device 3, slightly arched. The arching corresponds approximately to the arching on the outside of the inner neighbouring access device 3. As a result of the agreement in arching between the intermediate portion 19 and the access device 3 in a corresponding region, at least spot abutment between the inside of the intermediate portion 19 and the outside of the access device 3 is possible in the closed state of the clamp 1. Unlike the intermediate portion 15, the intermediate portion 19 is not permanently fixed against the access device 3.

The hinge members 17, 18 at the transition between each respective shank 2 and the intermediate portion 19 are necessary for an outward pivoting of the shanks 2 to be possible.

In FIG. 2, the tubular form of the access device 3 is more clearly visible, because of the view obliquely from beneath of the clamp 1 according to the invention.

Figure 3:
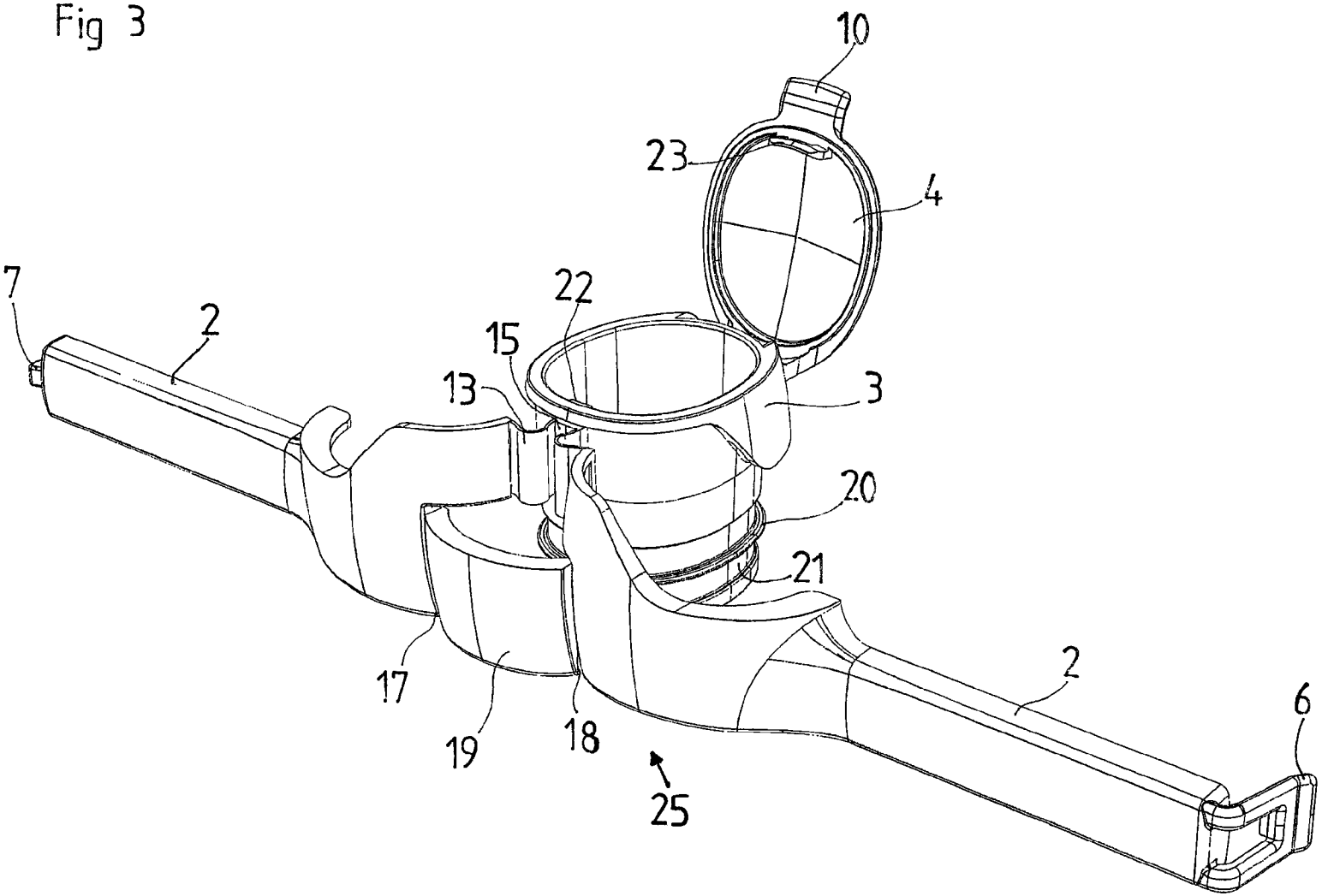
FIG. 3 is a perspective view of the clamp according to the present invention in the open state.

FIG. 3 shows the clamp 1 in an open position, where the shanks 2 have been pivoted out so far that they are practically in alignment with one another. The lid 4 is also shown in an open position. In the illustrated position, the access device 3 is connected to the remainder of the clamp 1 only via the intermediate portion 15.

The two shanks 2 and the interjacent hinge device 8 are now to a greater or lesser extent separated from the access device 3. The lower portion 12 of the hinge device 8 has been lifted out a distance from the access device 3 by a bending in the hinge members 17, 18 which are disposed in spaced apart relationship from one another and from the upper hinge members 13, 14 seen in the circumferential direction. When the upper parts of the shanks 2 are angled out from the access device 3 with the connection to the access device 3 between the hinge members 13, 14, each respective shank will be directed away from the access device 3. Since the lower, intermediate portion 19 is connected to the shanks 2 at a distance from the connection of each respective shank 2 to the access device 3 between the hinge members 13, 14, the ends of the intermediate portion 19 lying adjacent the hinge members 17, 18 must follow the shanks 2 in the outward movement when the shanks are pivoted away from one another on opening of the clamp 1. Since, the intermediate portion 19 is otherwise substantially rigid, the distance between the hinge members 17, 18 will be kept approximately constant on opening of the clamp. This entails that the intermediate portion is lifted out a distance from the access device 3 so that an interspace between the lower portion 12 of the hinge device 8 and the access device 3 occurs. At the same time, the rest of the access device 3 will be exposed when the shanks 2 are pivoted outwards.

As was previously mentioned, the access device 3 is substantially of tubular configuration, as is better apparent in the exposed position in FIG. 3. In FIG. 3, it is also apparent that the access device 3 has at least one circumferential flange 20 and at least one circumferential depressed portion 21. These function, together with corresponding formations 24 on the inside of the shanks 2, for improved clamping of the package. The width of that part on the access device 3 against which clamping of a package is to take place is of approximately the same extent as the width of the remainder of the shanks 2.

The open lid 4 of the access device 3 illustrates that position which the lid 4 assumes when the package has been clamped in place and the intention is to gain access to the contents of the package. With the lid 4 open, the contents of the package may either be poured out, or a spoon, a spice measure or other utensil may be lowered into the package for removing a part of its contents, on condition that the shaft of the utensil is sufficiently long.

FIG. 3 also shows the snap mechanism 22, 23 which makes it possible for the lid 4 to be reliably closed. On the inside of the access device 3 there is a locking heel 22, while on the inside of the lid 4, at its forward edge, just beneath the gripping flap 10, there is a corresponding stirrup 23 which yields resiliently on closure of the lid so that the locking heel 22 may engage with the stirrup 23.

Figure 4:
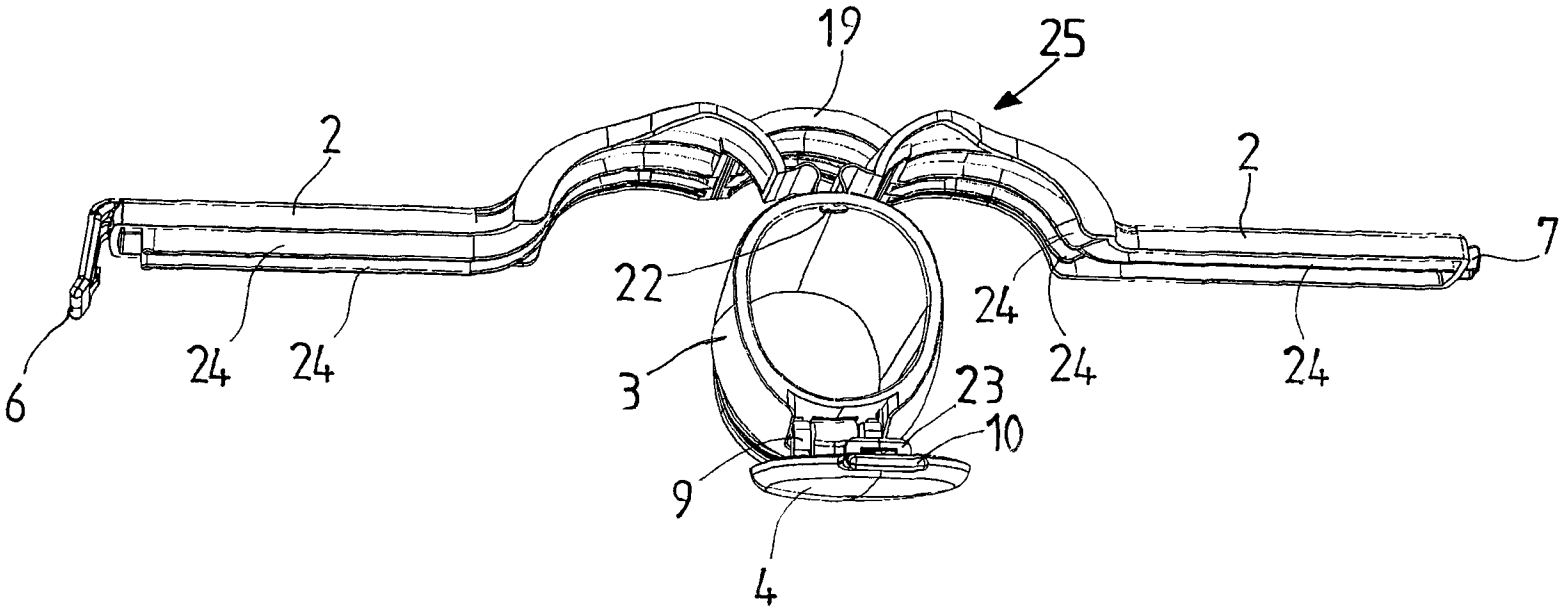
FIG. 4 is a perspective view from above of the clamp according to FIG. 3.

In FIG. 4, the clamp 1 according to the preferred embodiment is shown in a perspective view from above. The position of the clamp 1 corresponds to that shown in FIG. 3. In FIG. 4, it is more clearly visible that the access device 3, at its lower region below the upper portion 11 of the hinge device 8, is wholly exposed throughout its circumference. The distance to the shanks 2 and the intermediate portion 19 is also apparent from the figure. As a result, it is clear that the upper part of an opened package, for example a plastic bag, is insertable with an edge portion in the interspace between the access device 3 and the intermediate portion 19, and between the access device 3 and the inside of the shanks 2, respectively.

Depending upon its size, a part of the package may be fixedly clamped directly between the shanks 2.

It will also be apparent from the figure that the insides of the shanks 2 have flanges 24 and depressed portions for improved clamping of a package. The flanges 24 are disposed so that they lie approximately in register with corresponding depressed portions 21 on the access device 3 and the opposing shank 2, respectively. In the figure, it may also be discerned that the inside of the intermediate portion 19 as well is provided with corresponding flanges and depressed portions.

In the above-described embodiment and in the accompanying Drawings, only a single variation of many conceivable sealing arrangements according to the present invention has been described in detail. One method of modifying the embodiment which has been described is naturally to vary the size and shape of the access device 3 and the shanks 2, so that the sealing arrangement will be suitable for different package sizes and for different sizes of the pieces in the packed material.

Other closely related methods of modifying the arrangement according to the invention are to provide it with modified hinge devices and locking devices 5. Similarly, the sealing arrangement on the lid 4 may be replaced by some other variation known to a person skilled in the art, for example a thread.

Yet a further method of modifying the present invention is to cause the sealing device 1 to be designed in a different manner than a clamp. For example, a clamping union or the like, ideally with a grooved inside, may be fixed at the upper edge portion of the access device 3, at least along a limited part of its circumference. On closing of a package, the access device is moved down into the opening of the package at the same time as the surrounding sealing device, or the clamping union, is disposed around the outside of the package. Possibly, the package may be folded so that the entire opening is disposed inside the sealing device or the clamping onion. Thereafter, the clamping union is tightened using a mechanism known to a person skilled in the art and the package is sealed. The access device 3 is openable by means of a lid or the like so that the contents of the package may be poured out or accessed using a spoon.

The present invention may be modified further without departing from the scope of the appended Claims.

What is claimed is:

1. A sealing arrangement for sealing of a flexible package, comprising a circumferential sealing device which is connectable about an opening in the package, an openable access device which is disposed for insertion in the opening of the package, the sealing device being disposed about the access device for urging of the package against the access device, the sealing device comprising two shanks with a hinge device at one end of the shanks and an (Tenable locking device at their other end so that there is an interspace between the outside of the access device and the shanks in the open position of the sealing device along the entire circumference of the access device, the extent of the interspace along the outside of the access device being at least of a same order of magnitude as a width of the shanks so that an opening in the package is insertable in the interspace and clampable when the sealing device is closed, and the access device has an anchorage against a portion of the sealing device in association with the hinge device, wherein the hinge device includes two upper hinge members on either side of the anchorage and a further two lower hinge members in that portion of the shanks which defines the interspace between the shanks and the outside of the access device.

2. The sealing arrangement as claimed in claim 1, wherein the upper hinge members are disposed with a mutual spacing which is smaller than the mutual distance between the lower hinge members so that the portion between the lower hinge members is separated from the outside of the access device opening of the sealing device.

3. The sealing arrangement as claimed in claim 1, wherein the access device is tubular and that the inside of the shanks has a configuration which approximates the configuration of the outside of the access device.

4. The sealing arrangement as claimed in claim 1, wherein the access device and the shanks, respectively, are manufactured in two parts which are retro-assembled.

5. The sealing arrangement as claimed in claim 1, wherein the access device and the shanks, respectively, are manufactured from two different materials.

6. The sealing arrangement as claimed in claim 1, wherein the access device has a snap-action lid.

* * * * *